US010074948B2

(12) United States Patent
Goyal et al.

(10) Patent No.: US 10,074,948 B2
(45) Date of Patent: Sep. 11, 2018

(54) POWER RECEPTACLES WITH INTERNAL CHAMBERS FOR RELEASABLY HOLDING PORTABLE POWER DEVICES

(71) Applicant: Eaton Intelligent Power Limited, Dublin (IE)

(72) Inventors: Rahul Natwar Goyal, Tyrone, GA (US); Pramod Kumar, Peachtree City, GA (US)

(73) Assignee: Eaton Intelligent Power Limited, Dublin (IE)

( * ) Notice: Subject to any disclaimer, the term of this patent is extended or adjusted under 35 U.S.C. 154(b) by 126 days.

(21) Appl. No.: 14/836,512

(22) Filed: Aug. 26, 2015

(65) Prior Publication Data

US 2017/0063008 A1 Mar. 2, 2017

(51) Int. Cl.

| | |
|---|---|
| ***H01R 27/02*** | (2006.01) |
| ***H01R 13/639*** | (2006.01) |
| ***H01R 13/66*** | (2006.01) |
| *H01R 13/713* | (2006.01) |
| *H01R 103/00* | (2006.01) |
| *H01R 24/78* | (2011.01) |
| *H01R 107/00* | (2006.01) |

(52) U.S. Cl.

CPC ..... *H01R 27/02* (2013.01); *H01R 13/6395* (2013.01); *H01R 13/6675* (2013.01); *H01R 13/7135* (2013.01); *H01R 24/78* (2013.01); *H01R 2103/00* (2013.01); *H01R 2107/00* (2013.01)

(58) Field of Classification Search

CPC .... H01R 9/2425; H01R 13/53; H01R 13/447; H01R 13/453; H01R 13/633; H01R 13/635; H01R 13/4534; H01R 13/6335; H01R 13/7135; H01R 27/02; H01R 13/6395

USPC ..... 439/159, 160, 620.21, 136–142, 535

See application file for complete search history.

(56) References Cited

U.S. PATENT DOCUMENTS 4,079,344 A * 3/1978 Lauben ..... H01H 83/02 335/2

4,605,270 A * 8/1986 Aslizadeh ..... H01R 13/447 439/135

(Continued)

OTHER PUBLICATIONS

Amazon.com, RCA WP2UWR USB Wall Plate, RCA, product listing for sale, date unknown but prior to filing date of the present application, 1 page.

(Continued)

*Primary Examiner* — Tulsidas C Patel
*Assistant Examiner* — Travis Chambers
(74) *Attorney, Agent, or Firm* — Myers Bigel, P.A.

(57) ABSTRACT

A power receptacle with a housing having an inwardly extending chamber, the inwardly extending chamber having a depth dimension that is between 0.5 inches and 5 inches, more typically between 1 and 5 inches, sized and configured to releasably receive a portable power supply inside the chamber. The housing includes an internal electrical charging interface. When the portable power supply is in the chamber, the portable power supply electrically engages the electrical charging interface to thereby charge the portable power supply. The receptacles can be in-wall or in-floor units. The housings can be a "custom" housing size and/or may be configured to occupy a single gang box or a compartment of a multi-gang junction box.

16 Claims, 7 Drawing Sheets

(56) References Cited

U.S. PATENT DOCUMENTS 6,050,849 A * 4/2000 Chang ..... G06F 1/16 439/536
6,109,935 A * 8/2000 Yang ..... H01R 12/725 439/80
6,765,787 B2 * 7/2004 Beasley, III ..... H02B 1/52 174/480
D598,859 S 8/2009 Vaccaro et al.
7,618,272 B2 * 11/2009 Cheng ..... H01R 13/5213 439/138
8,221,158 B2 * 7/2012 Liao ..... H01R 13/60 439/535
8,646,936 B2 * 2/2014 Goyal ..... F21S 8/035 315/294
8,801,441 B2 * 8/2014 Zhang ..... H02J 7/0044 439/131
9,083,180 B2 * 7/2015 Dodal ..... H02H 3/16
9,161,464 B2 * 10/2015 Liao ..... H05K 5/0065
9,455,543 B2 * 9/2016 Liao ..... H01R 27/02
2004/0067667 A1 * 4/2004 Kuroki ..... H01R 13/4532 439/138
2012/0069518 A1 * 3/2012 Hsu ..... G06F 1/1656 361/679.58
2012/0292991 A1 * 11/2012 Dodal ..... H02H 3/16 307/11
2013/0109219 A1 * 5/2013 Liao ..... H01R 13/743 439/345
2015/0295374 A1 * 10/2015 Gorman ..... H01R 31/065 439/189

OTHER PUBLICATIONS

Arrow/Hart, Self-test GFCI receptacles, EATON product brochure, date unknown but prior to the filing date of the present application, 2 pages.

Plug with USB port, product example, http://safe4work.org/plug-with-usb-port, date unknown but prior to the filing date of the present application, printed from the internet Aug. 21, 2015, 1 page.

Primus Cable, In-Wall Charging Wall Plate, 1x Power Outlet & 2x USB Charging Ports—White, product listing for sale, http://www.primuscable.com/ . . . , date unknown but prior to the filing date of the present application, printed from the internet Jul. 8, 2015, 4 pages.

Various makers, USB wall charger product examples, date unknown but prior to the filing date of the present application, 1 page.

* cited by examiner 10
190
20p
15
10h
150
152p
170
152
150e
160
180
150b
150i
11
12
30
20
25

190
12
10i
10h
H
D
150
150e
15
20
25
11

14
12w
12
170
H
15
150e
W
160
152
150

POWER RECEPTACLES WITH INTERNAL CHAMBERS FOR RELEASABLY HOLDING PORTABLE POWER DEVICES

FIELD OF THE INVENTION

The present invention relates to power receptacles.

BACKGROUND OF THE INVENTION

Some in-wall receptacles only allow an option to charge a portable electronic device such as a cellular telephone or computer using a USB cable or a power cord.

SUMMARY OF EMBODIMENTS OF THE INVENTION

Embodiments of the present invention are directed to power receptacles with an internal chamber sized and configured to hold a detachable, portable power supply. The power receptacle can, for example, be an in-wall or in-floor receptacle.

Embodiments of the invention are directed to power receptacles that include a housing having an inwardly extending chamber. The inwardly extending chamber has a depth dimension that is between 0.5 and 5 inches that is sized and configured to releasably receive a portable power supply inside the chamber. The housing includes an internal electrical interface. When the portable power supply is in the chamber, the portable power supply electrically engages the electrical interface to thereby power and/or charge the portable power supply.

The power receptacle can include at least one externally accessible electrical socket.

The power receptacle can include at least one externally accessible Universal Serial Bus (USB) port.

The power receptacle can include a front cover attached to the housing. The front cover can have a window extending over a front end of the chamber. The power receptacle can include first and second externally accessible electrical sockets with ports extending through the cover, one above the chamber and one below the chamber.

The power receptacle can include a ground strap extending between the housing and a front cover attached to the housing.

The power receptacle can be configured as an Arc Fault Circuit Interrupter (AFCI) or Ground Fault Circuit Interrupter (GFCI) receptacle.

The power receptacle can include a front cover attached to the housing. The front cover including or exposing a member that is configured to cause the portable charger to be ejected from the chamber.

The chamber can have a depth between 1.3 and 2 inches.

The chamber can be sized and configured to reside in a single gang box, a custom size gang box, or in a space of a standard multiple gang box.

The chamber can have width and height dimensions that are both less than 1.31 inches and a depth dimension that is greater than the width and height dimensions.

The internal electrical interface can include an electrical charging interface which comprises charging contacts extending inward from at least one interior wall of the chamber.

The internal electrical interface can include an internal electrical charging interface comprises a male USB connector.

The power receptacle can be used in combination with a portable charger in the chamber. The portable charger can be configured to slidably enter the chamber and be held so that a front end thereof is flush, recessed or protrudes less than 0.25 inches from a front cover with a window over the chamber. The front cover can be attached to the housing. The portable power supply can include a first USB port on one end that is externally accessible when the power supply is in the chamber. The portable power supply can include a second USB port that resides inside the chamber when the power supply is in the chamber for charging.

The housing can include or be in communication with a circuit that connects to hot, ground and neutral of an electrical circuit (of an external structure such as a building).

Other embodiments are directed to power receptacles with a housing having an inwardly extending chamber. The inwardly extending chamber has a depth dimension sized and configured to releasably receive a portable power supply inside the chamber. The housing has an internal electrical interface. When the portable power supply is in the chamber, the portable power supply electrically engages the electrical interface to thereby power and/or charge the portable power supply. The power receptacle can also include at least one externally accessible electrical socket and at least one externally accessible Universal Serial Bus (USB) port.

The power receptacle can also include a front cover attached to the housing. The front cover can have a shutter that opens to allow a respective portable power supply to be inserted into the chamber.

The at least one externally accessible electrical socket can be configured as first and second externally accessible electrical sockets one above the chamber and one below the chamber. The at least one USB port can reside adjacent the chamber, between the chamber and one of the at least one electrical socket.

The inwardly extending chamber can be sized and configured to enclose at least a major portion of a length dimension of the portable power supply.

The power receptacle can include an eject member facing out of the cover. A user can manually depress the eject member to cause the charger to be released from the chamber.

Other embodiments are directed to portable chargers that include a charger body having a length that is between 2 and 5 inches and a width and height dimension that is less than 1.31 inches. The charger body can have a Universal Serial Bus (USB) port on one end portion and a mini or micro-USB port.

The charger body can include a plurality of indicator lights at least one of which is on a left side of the USB port and at least one of which is on a right side of the USB port.

The charger body can be sized and configured to releasably engage an electrical interface inside a power receptacle for charging.

The portable charger can be rectangular with a height dimension that is less than a width dimension.

Still other embodiments are directed to methods of charging and/or powering electronic devices, comprising: inserting a portable charger with at least one external electrical connector (i.e., a Universal Serial Bus (USB)) into an inwardly extending chamber of a power receptacle to enclose at least a major portion of a length dimension of the portable power charger; electrically engaging an internal electrical charging/powering interface when inserted into the chamber to charge the portable charger; then slidably removing the portable charger from the chamber.

The power receptacle can includes one or more plug-in sockets.

The power receptacle may optionally be configured as a GFCI or AFCI.

The method can also include moving a shutter across and/or over a front entry portion of the chamber after and/or in response to the slidably removing step.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figures 1A, 1B, 1C:
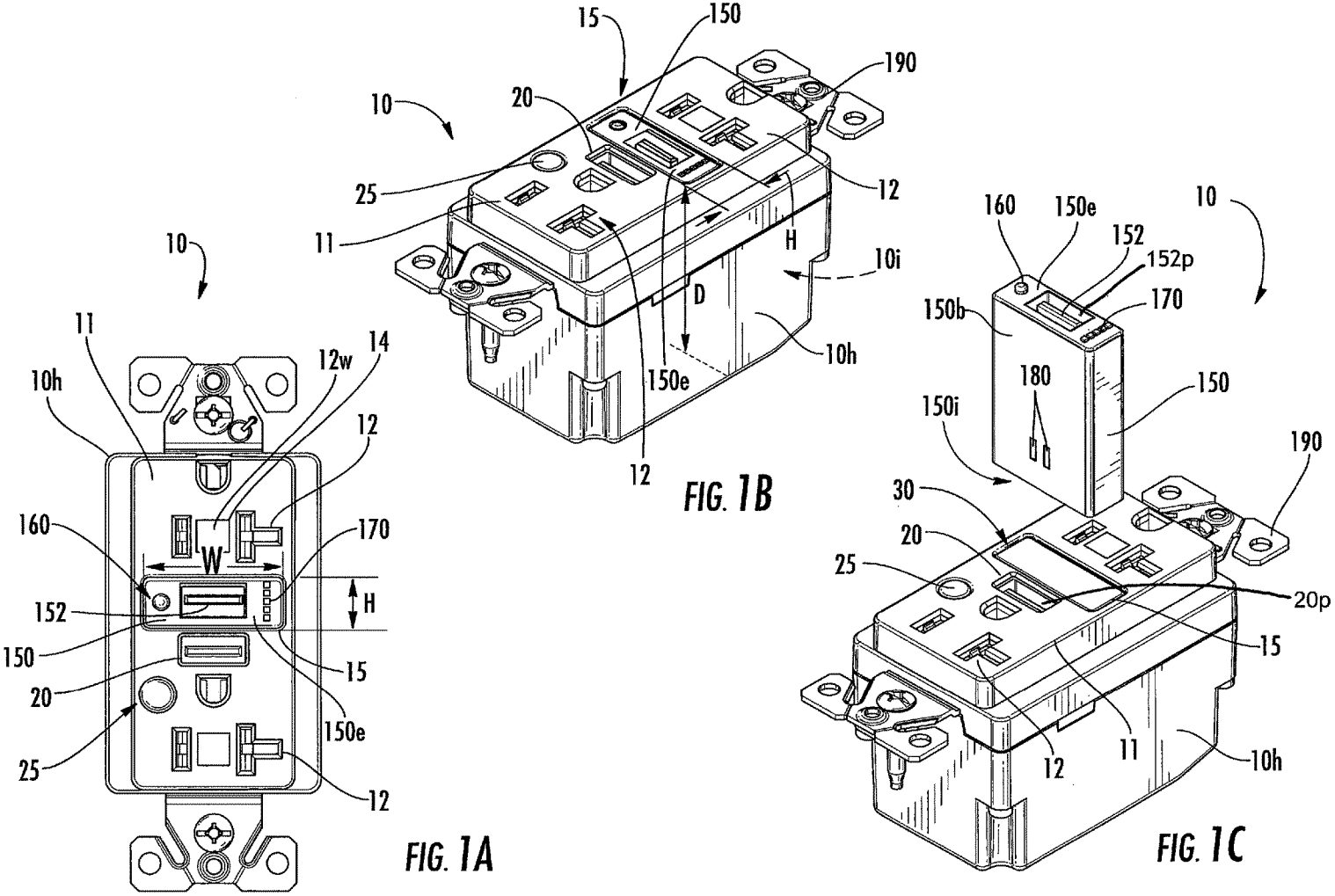
FIG. 1A is a front view of an exemplary power receptacle according to embodiments of the present invention.
FIG. 1B is front, side perspective view of the exemplary power receptacle shown in FIG. 1A.
FIG. 1C is a front, side perspective view similar to that shown in FIG. 1B, but illustrating a portable charger removed from the receptacle according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10'''). Abbreviated versions of the word "Figure" such as "FIG." and "Fig." are used interchangeably in the application.

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "controller" is used broadly and includes control circuitry and can include one or more microcontrollers, microprocessors, programmable logic controllers (PLCs), digital signal processors (DSPs), or Integrated Circuits (ICs). The ICs can optionally include at least one Application-Specific Integrated Circuits (ASICs).

The term "module" refers to an assembly that includes hardware and software components.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Turning now to the figures, FIGS. 1A-1C illustrate an exemplary power receptacle 10, also interchangeably referred to as a "receptacle." As is well known, a power receptacle is a point of connection between electrical devices, such as computers, and a power distribution system, such as a power distribution of a structure such as a building. The power receptacle 10 can be configured, for example, as an in-floor, in-wall device, surface-mount device, or a device integrated into another device or even as an appliance.

As shown, the receptacle 10 can have a housing 10*h* and can include an internal cavity or chamber 15 sized and configured to hold a portable power supply device 150, such as a rechargeable battery and/or a device with an electrical interface for transferring/storing data, for example. The internal chamber 15 can include internal charging contacts to allow the receptacle 10 to charge and/or power the portable power supply device 150 when in the internal chamber 15. The internal chamber 15 can include a charger and/or the power supply that is received in the chamber 15 can include a charger. The term "chamber" refers to an internal open space, cavity or pocket sufficiently sized to accept the body of the portable power supply device 150 and is not required to have walls surrounding or enclosing the space.

The internal chamber 15 can be sized and configured to receive at least a portion of the portable power supply body 150*b* of the portable power supply device 150, typically at least 50% of a length dimension of the body 150*b*.

The internal chamber 15 can be configured to releasably hold the portable power supply device 150 so that one end 150*e* faces outward from the receptacle 10. The outwardly facing end 150*e* can be flush, protrude or be recessed into the chamber 15. The outwardly facing end 150*e* can hold a power connector 152, such as, for example, a Universal Serial Bus ("USB") port 152*p*. The USB port 152*p* can be a Type A, Type B or Type C and can be/accept a 1.0, 2.0, 3.0, 3.1 or later standard USB connector. The power connector 152 can have other configurations based on different manufacturer standards or configurations, e.g., Apple, Inc, Cupertino, Calif., connectors, that may not be USB compliant.

The portable power supply device 150 can include another connector of a different size and/or type, such as, for example, a second USB port 158 that is held inside the chamber 15 during charging so that it is not externally accessible by a user during charging. Typically, where used, the second USB port 158 can be held on an inwardly facing end 150*i* of the power device 150. The second USB port 158 can be, for example, a miniature (mini) or micro USB port. The term "miniature" with respect to "USB port" refers to a smaller connector than the USB that is often used by handheld electronic devices such as mobile phones, MP3 players, and digital cameras. On mobile phones it is often used for both USB data connectivity as well as charging. The micro USB port is (slightly) smaller than the mini-USB port.

The portable power supply device 150 can include a user interface, such as an input 160 which may be a depressible button, which allows a user to press the button to determine a charge level of the portable device. The user interface of the portable power supply device 150 can include one or more indicator lights 170, shown as a plurality of adjacent indicator lights, to indicate a charge level. One of the indicator lights 170 may illuminate or flash when the portable power supply device 150 is charging.

Although the chamber 15 is shown as horizontally oriented, the chamber 15 may be provided in other orientations such as a vertical orientation (not shown).

The receptacle 10 can be configured as a single receptacle. In some embodiments, the receptacle 10 can be configured as a single gang, dual gang or other multiple gang receptacle.

When oriented horizontally, the chamber 15 can have a width "W" dimension that is between 1-3 inches, typically between about 1 inch and about 1.3 inches. The chamber 15 can have a height "H" dimension that is between 0.25 inches and 2 inches, typically between 0.5 inches and 0.75 inches. The chamber 15 can have a depth "D" dimension that is between 0.25 inches to 5 inches, such as between 0.5 inches to about 5 inches, and is typically between 1-5 inches, and more typically between about 1.3 inches to about 2 inches. The chamber depth D can be greater than the height and the width dimensions. The height dimension H can be less than the width dimension W. When the chamber 15 is oriented vertically, the height dimension H becomes the width dimension W, and the width dimension becomes the height dimension H.

Referring to FIGS. 2A, 2B and 3A-3D, portable power supply device 150 can have a width (W) dimension, height (H) dimension, and a length (e.g., also known as a "depth") dimension. The W and H dimensions are the same or less than corresponding dimensions of the chamber 15. In the orientation shown in FIG. 3A, the portable power supply device 150 can have a width "W" dimension that is between 1-3 inches, typically between 1 inch and about 1.25 inches. The portable power supply device 150 can have a height "H" dimension that is between 0.25 inches and 2 inches, typically between 0.5 inches and 0.75 inches. The portable power supply device 150 can have a length dimension "L" dimension that is between 1-5 inches, typically between about 1.3 inches and 2 inches. The length L can be greater than the height and the width dimensions. The height dimension H can be less than the width dimension W. The first end 150*e* can hold a connector 152 such as a USB port. The an inwardly facing end 150*i* can hold a second connector such as the second USB port 158. The connectors 152 and/or the second USB port 158 can connect to a cable to allow a user the flexibility to charge the portable power supply device 150 via a USB port or power-plug-in as conventional, when a receptacle 10 is not available. The portable power supply device 150 can be lightweight, typically under 1 pound, and can provide about 2800 milliamp-hour (mAh) or more power.

The chamber 15 can be sized and configured to enclose at least a major portion (50% or more) of a length dimension of the portable power supply.

The portable power source 150 can be configured to charge an electronic device when disconnected from the receptacle 10. The portable power source 150 can be configured to plug into another power source away from the receptacle 10 to charge itself and/or a device connected to the power source 150.

In some embodiments, a user can charge an electronic device directly using a power connector 20 such as a USB port 20*p* and/or a socket 12 and concurrently charge portable power supply device 150. Thus, the portable power supply device 150 can be a back-up power source for the electronic device, e.g., cellular, satellite or other telephone, smartphone, electronic notebook, laptop, MP3 player, and the like.

The power receptacle 10 can include only the chamber 15 for charging a portable power source 150 or more than one portable power source in more than one chamber 15 but is typically configured with at least one socket 12 and can have at least one other power connector 20 such as a USB port.

As shown in FIGS. 1A-1C, the power receptacle 10 can optionally be configured to have at least one female connector or socket 12 which is configured to engage male connectors (plug-in electrical connectors).

As shown in FIGS. 1A-1C, the power receptacle 10 may include at least one externally accessible power connector 20 such as a USB port 20*p*. The at least one power connector 20 (e.g., USB port) can reside under, over or to a side of the chamber 15. The power receptacle 10 can be configured to power, typically charge, a device connected to the connector 20 via a cable concurrently with charging the portable power supply device 150 in the chamber 15. Similarly, one or more electrical cords may be plugged into a respective socket 12 concurrently with the power connector, e.g., USB port, 20 and/or chamber 15.

The receptacle 10 can include a user interface member 25 that can eject the portable power device 150 from the chamber 15 when activated/depressed.

The receptacle 10 may include a ground strap 190 that resides between the housing 10*h* and the outlet cover 11.

Figures 4A, 4B, 4C:
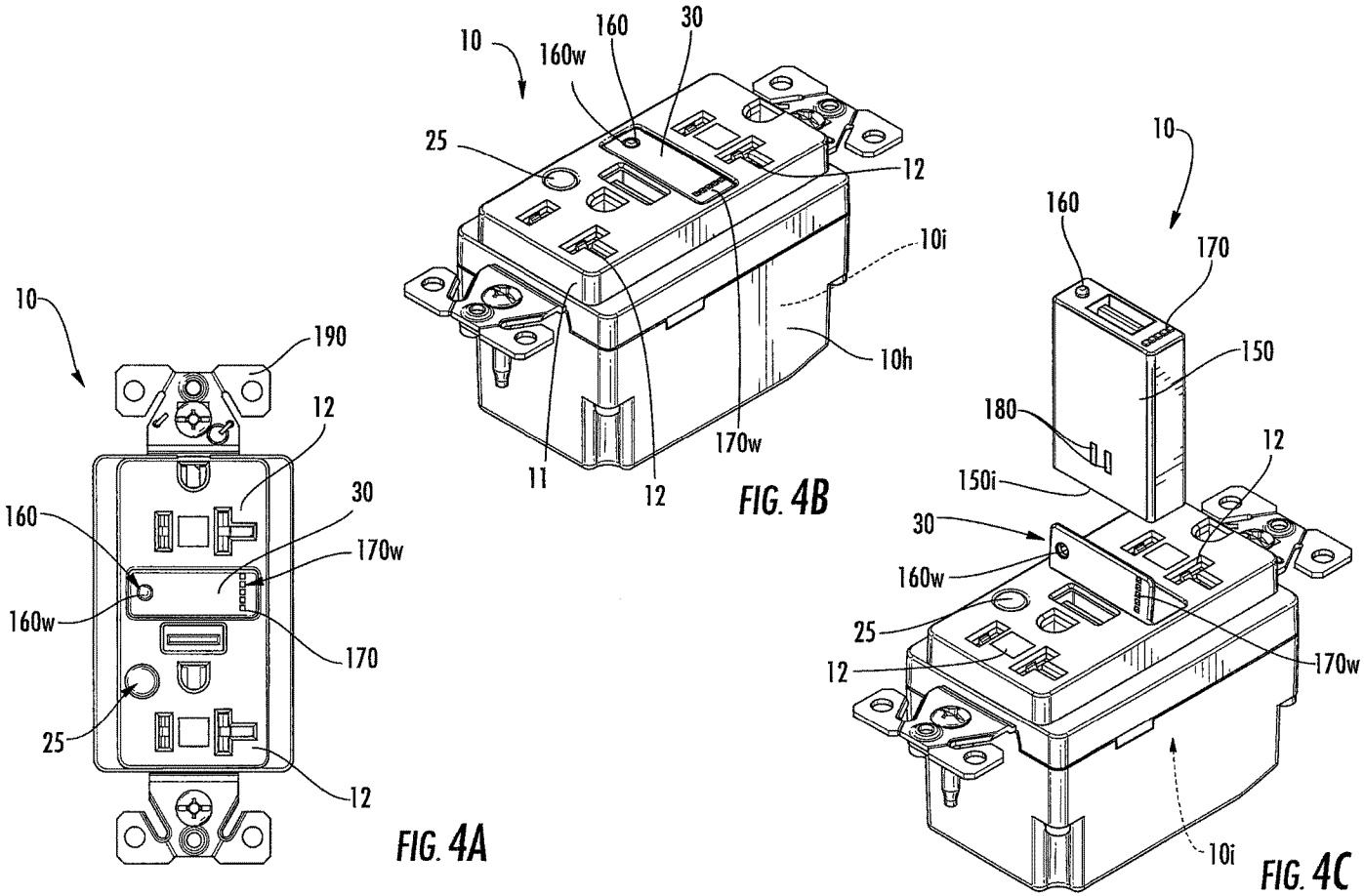
FIG. 4A is a front view of an exemplary power receptacle according to embodiments of the present invention.
FIG. 4B is front, side perspective view of the exemplary power receptacle shown in FIG. 4A.
FIG. 4C is a front, side perspective view similar to that shown in FIG. 4B, but illustrating a portable charger removed from the receptacle according to embodiments of the present invention.

The receptacle 10 can include a shutter 30 (FIG. 1C) that resides over the front of the chamber 15. The shutter 30 can open to provide access to the chamber 15. The shutter 30 can slide or pivot open or operate in any other suitable manner. The shutter 30 can remain open (recessed into the body of the receptacle) when a portable power supply device 150 is in the chamber 15 as shown in FIGS. 1A and 1B. In some embodiments, the shutter 30 can open to allow portable power supply device 150 to enter the chamber 15, then close to enclose portable power supply device 150 in the chamber 15 when portable power supply device 150 is fully inserted in the chamber (FIGS. 4A-4C).

In some embodiments, the receptacle 10 can include a plurality of externally accessible power ports 20, e.g., USB ports and/or a plurality of chambers 15 (not shown).

The receptacle 10 can include an electrical interface 10*i* that charges the portable power supply device 150. The interface 10*i* can reside inside the chamber 15, enclosed by the housing 10*h* (FIG. 1A). The interface 10*i* can reside outside the chamber 15, such as on a front panel, shutter 30 or sidewall of the receptacle 10 in a position to electrically engage the portable power supply device 150 (not shown). The portable power supply device 150 can be configured to be charged by the receptacle 10 as well as via conventional sources such as a plug-in power cable to a different power supply and/or a USB port 20*p*.

Figure 3A:
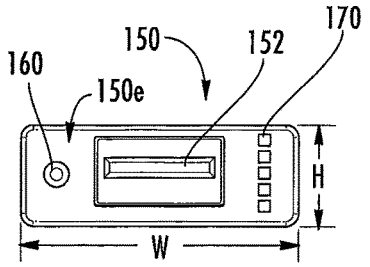
FIG. 3A is a front view of the portable power device shown in FIG. 2A.
Figure 3B:
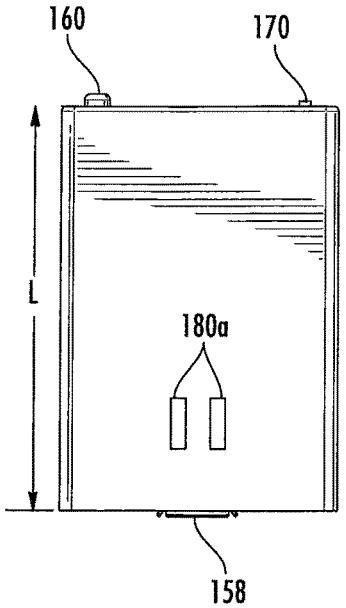
FIG. 3B is a top or bottom view of the device shown in FIG. 3A.
Figure 3C:
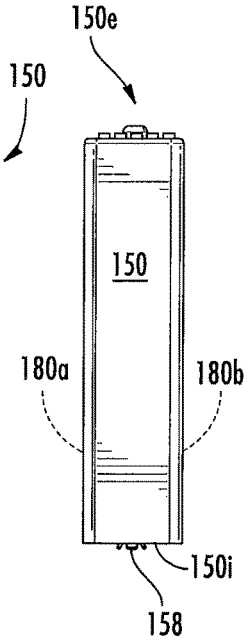
FIG. 3C is a side view of the device shown in FIG. 3A.
Figure 3D:
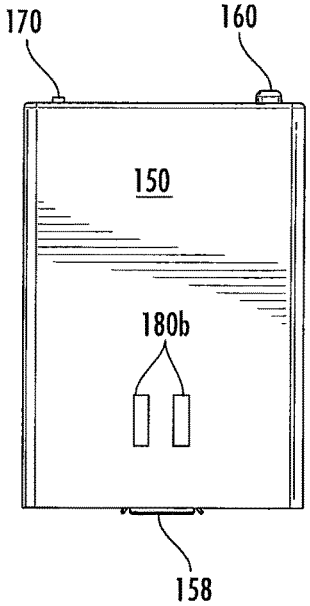
FIG. 3D is an opposing top or bottom view of the view of the device shown in FIG. 3B.
Figure 3E:
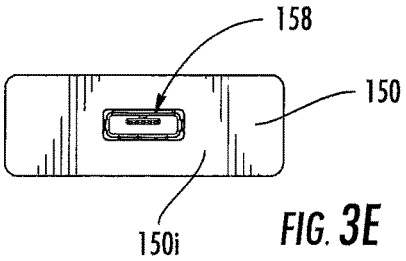
FIG. 3E is a rear view of the portable device shown in FIG. 3A.

As shown in FIGS. 1C, 3B, 3D and 4C, the portable power supply device 150 can include at least one pair or set of contacts 180 that can electrically engage (power and/or charge) contacts in the receptacle 10. The contacts 180 can be used as test contacts to confirm proper electrical connection between the receptacle charging connection and the portable power supply device 150 and/or may be used as charging contacts. FIGS. 3B and 3D illustrate that both the primary surfaces can hold a set of electrical contacts 180, e.g., front/back contacts 180*a*, 180*b*, which may be positioned offset from each other or aligned on the opposing surfaces (the aligned configuration is shown in FIGS. 3B, 3D).

Figure 2A:
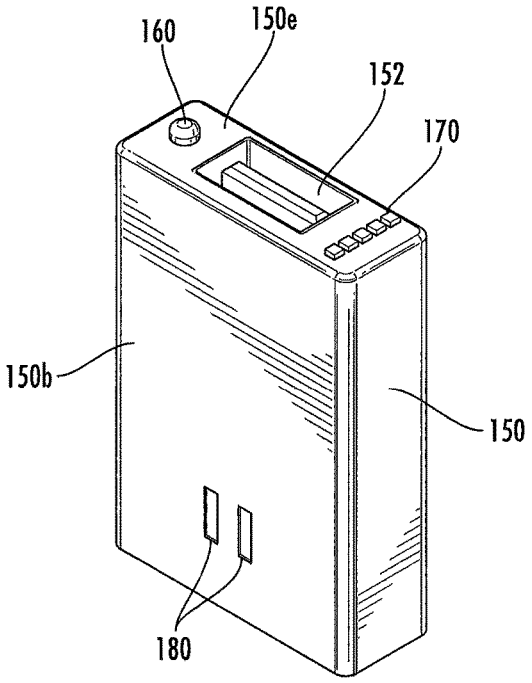
FIG. 2A is a side perspective view of a portable power device that can be releasably held by the receptacle shown in FIG. 1A for charging according to embodiments of the present invention.
Figure 2B:
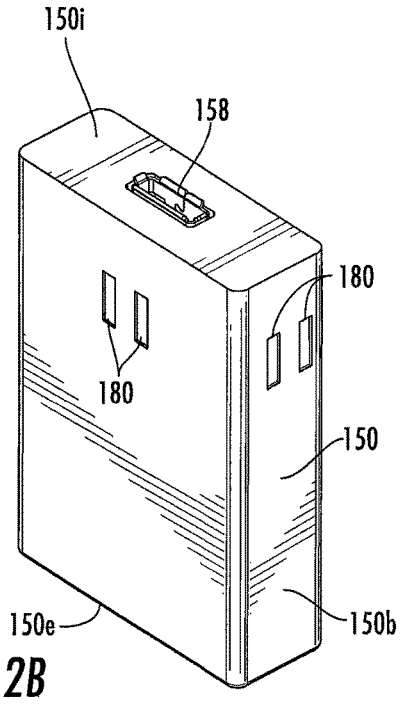
FIG. 2B is an opposing side perspective view of the device shown in FIG. 2A according to embodiments of the present invention.

As shown in FIG. 2B, electrical contacts 180 can be provided on a side of the portable power supply device 150 without the front/back contacts 180*a*, 180*b* and/or with one or both of the sets of front/back contacts (FIGS. 3B, 3D) which may reduce chamber size and/or length of the portable power supply device 150.

Figure 5A:
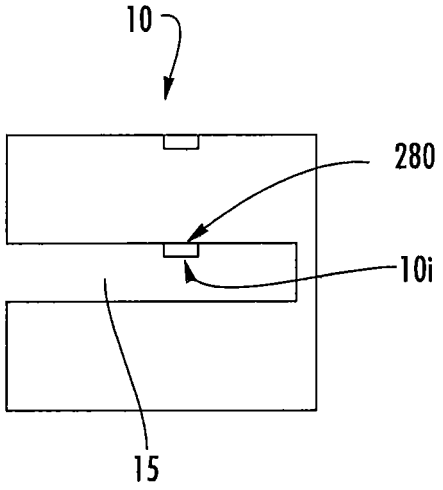
FIG. 5A is a schematic partial section view of an exemplary receptacle with a portable charger internal charging interface according to embodiments of the present invention.
Figure 6B:
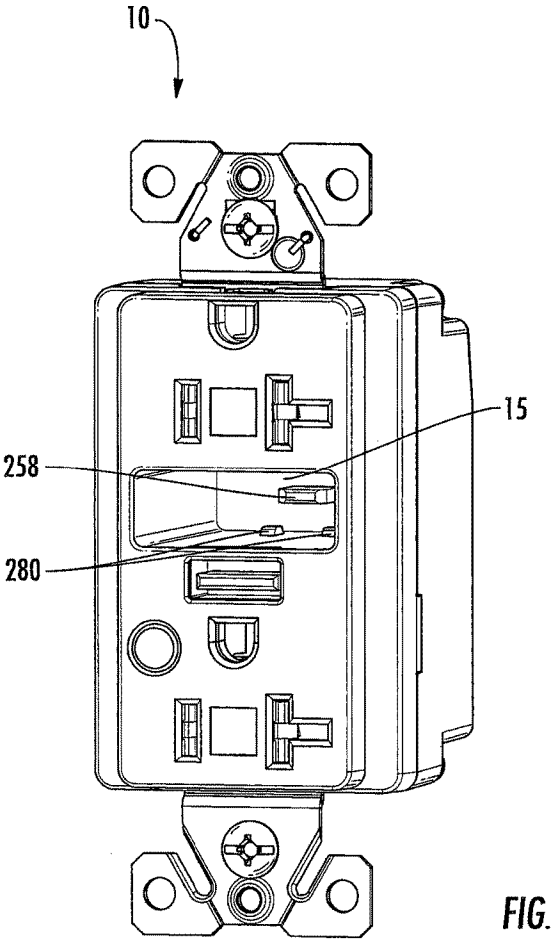
FIG. 6B is a front, side perspective view of the device shown in FIG. 6A.
Figure 6A:
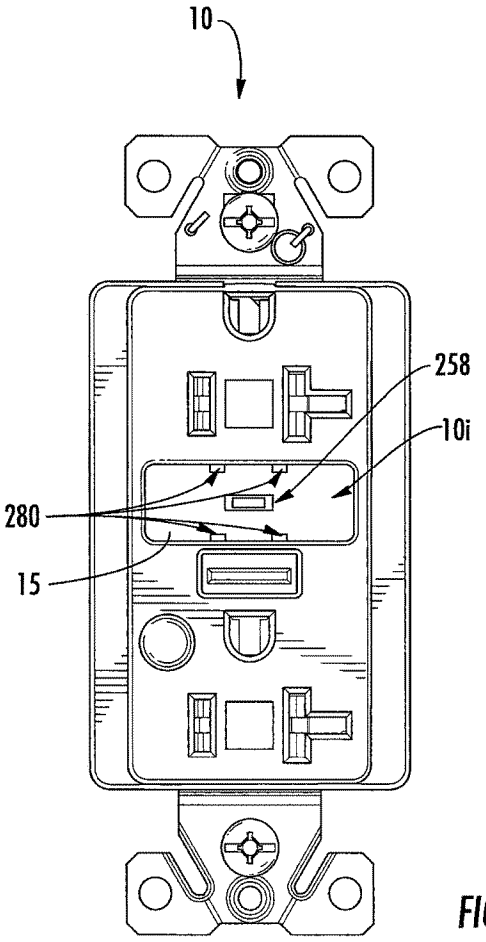
FIG. 6A is a front view of an exemplary receptacle with a portable charger internal charging interface according to embodiments of the present invention.

The receptacle 10 can include an electrical interface 10*i* with a charging contact connection 280 which can be held by and/or placed on an adjacent wall or walls or other surfaces in the chamber 15 to provide the electrical interface 10*i* as shown, for example, in FIGS. 5A, 6A and 6B.

Figure 5B:
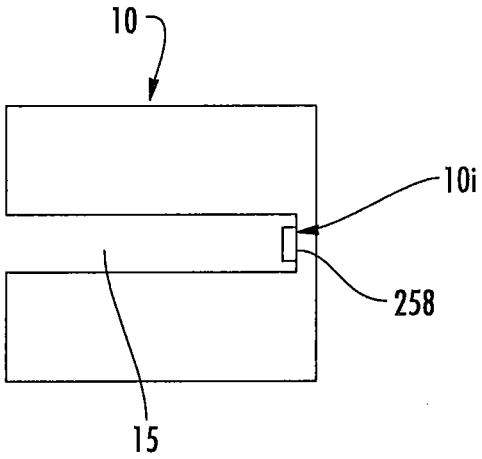
FIG. 5B is a schematic partial section view of an exemplary receptacle with a portable charger internal charging interface according to embodiments of the present invention.

In some embodiments, the portable power supply device 150 can electrically engage the receptacle 10 via a connector 20 or via a different connector 158, such as, for example, a mini or micro USB port. In some embodiments, the receptacle 10 can include an internal charging interface 10*i* with an internal connector 258 such as a USB connector or other corresponding connector that engages the connector/USB port 158 (with respective charging slots) as shown in FIGS. 5B, 6A and 6B. The internal connector 258 can be held by or adjacent a small printed circuit board for connection to the power circuit. In some embodiments, the portable power supply device 150 can electrically engage the receptacle 10 for charging and/or powering using both the electrical contacts 180 and the connector/USB port 158 and charging contacts 280, internal connector 258. In some embodiments, the portable power supply device 150 can electrically engage only one of the internal charging interfaces, such as one or both of the charging contacts 280 or one set of charging contacts or only the internal connector 258.

FIGS. 4A-4C illustrate that the shutter 30 can include windows 160*w*, 170*w* that align with a respective status "check" input 160 and the at least one illumination indicator light 170 of the portable power source/supply 150. The windows 160*w*, 170*w* can be open apertures or visually transmissive material. Some or all of the shutter 30 may be configured with visually transmissive (transparent or translucent) material. The shutter 30 can be configured in various ways and, indeed, is an optional feature. The shutter 30 can be spring-loaded to self-close when the power supply 150 is removed from the chamber 15.

The receptacle 10 can be configured as an Arc Fault Circuit Interrupter (AFCI) and/or Ground Fault Circuit Interrupter (GFCI) receptacle. As is well known, AFCI and GFCI receptacles are among a variety of overcurrent protection devices used for circuit protection and isolation. A GFCI is a device that shuts off an electric circuit when it detects that current is flowing along an unintended path to reduce the risk of electric shock. The GFCI can be manually reset by pushing a reset button. There can also be a test button that can be used to verify that the GFCI works. An AFCI can be designed to help prevent fires by detecting an unintended electrical arc and disconnecting the power before the arc starts a fire.

In some embodiments, the receptacle 10 can be an in-wall electrical unit that can be configured as an outlet branch circuit (OBC) AFCI or GFCI unit which can electrically monitor for electrical potential on load terminals to thereby provide positive feedback regarding certain operational states such as TRIP/RESET status and/or wiring errors of a unit which can optionally include at least one plug-in socket 12. The receptacle 10 can have the line and load sides.

Figure 7:
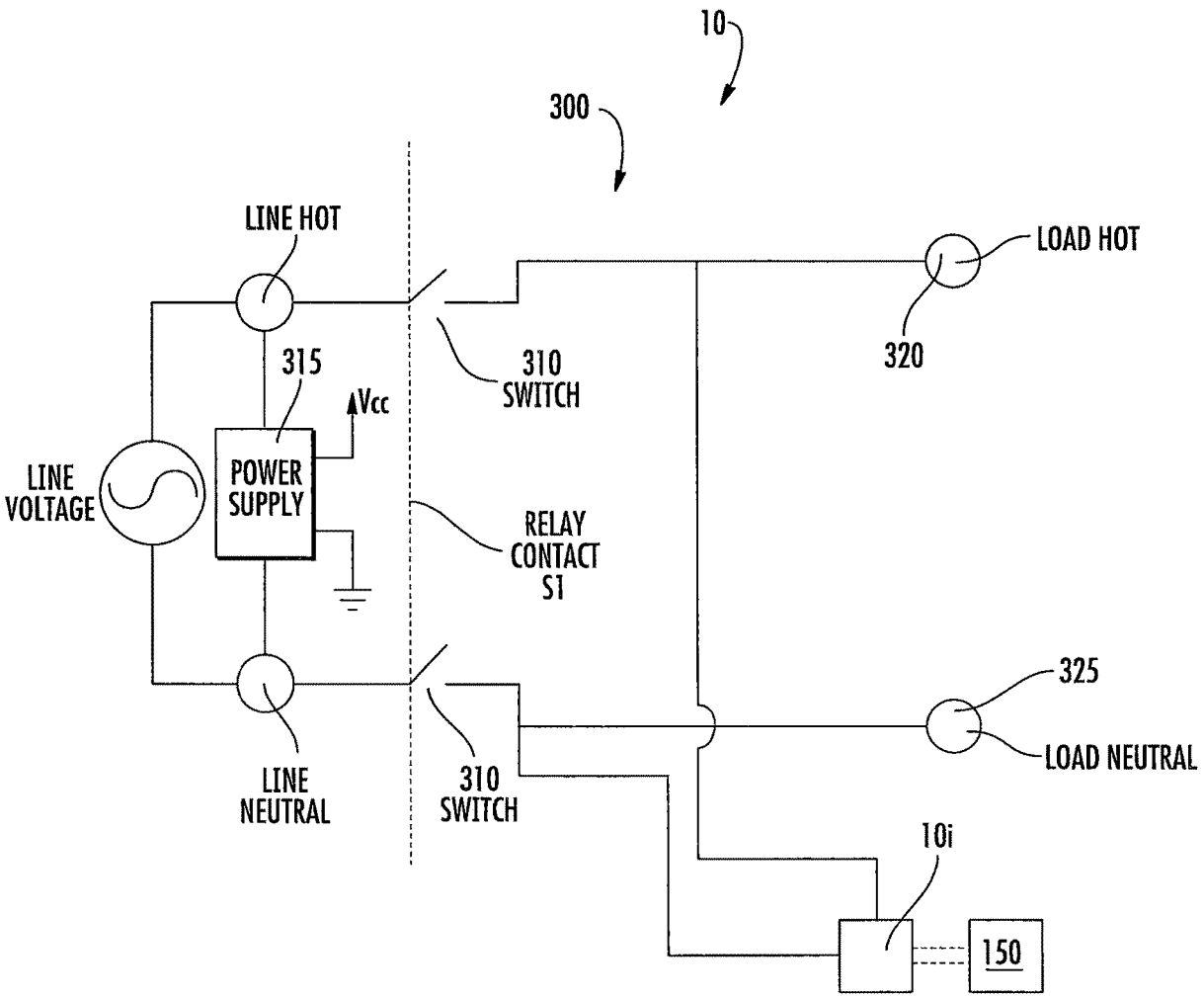
FIG. 7 is a schematic illustration of a power receptacle according to embodiments of the present invention.

Referring to FIG. 7, the receptacle 10 can form part of a power circuit which can include a trip monitoring circuit 300 that can be configured to open/close the circuit via at least one switch 310. The circuit 300 can include an onboard controller for controlling indicator and status lights and/or other components. The term "switch" is used broadly to refer to any controllable circuit interruption device and may, for example, include a relay/contact S1 separating the line side voltage from the load side of the receptacle 10. A power supply 315 can be connected to both line hot and line neutral. The electrical interface 10*i* for the power supply 150 can connect to the load side of the receptacle 10.

In some embodiments, the receptacle 10 can include a visual indication light which can optionally include at least two different LEDs aligned with a window for providing at least two different defined colors, e.g., "red" for ground fault, "TRIP" or "RESET" and green for no TRIP or no ground fault, for example. Light guides or fiber optic fibers may also be used to direct the visual light output to the at least one window (not shown). Referring again to FIG. 6, a respective load terminal 320 can be in communication with a load contact. The load hot contact connects to the load hot branch and/or terminal. The load neutral contact 325 connects to the load neutral branch and/or terminal. The unit housing 10*h* can hold the circuit 300 that is configured to detect a fault and to interrupt power to the load side.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A power receptacle, comprising:

a housing having an inwardly extending chamber, the inwardly extending chamber having a depth dimension that is between 0.5 and 5 inches sized and configured to releasably receive a portable power supply inside the chamber, wherein the depth dimension is greater than a width and height dimension, wherein the housing comprises an internal electrical interface in the chamber, wherein, when the portable power supply is in the chamber, the portable power supply electrically engages the electrical interface to thereby power and/or charge the portable power supply, wherein the power receptacle comprises at least one externally accessible electrical socket, and wherein in a ready-to-use configuration, the chamber directly and serially receives different user rechargeable power supplies; and a ground strap extending between the housing and a front cover attached to the housing, wherein the housing is sized and configured to reside in a single gang box, wherein a front end of the chamber is behind a window in an external outlet cover attached to the housing, and wherein the internal electrical interface serially and directly couples to electrical contacts on the different user power supplies.

2. The power receptacle of claim 1, further comprising at least one externally accessible Universal Serial Bus (USB) port.

3. The power receptacle of claim 1, wherein the power receptacle is configured as an Arc Fault Circuit Interrupter (AFCI) or Ground Fault Circuit Interrupter (GFCI) receptacle.

4. The power receptacle of claim 1, wherein the chamber has a depth between 1.3 and 2 inches, and wherein the housing with the chamber is sized and configured to reside in a single gang box, a custom size gang box, or in a space of a standard multiple gang box.

5. The power receptacle of claim 1, wherein the chamber has width and height dimensions that are both less than 1.31 inches and a depth dimension that is greater than the width and height dimensions.

6. The power receptacle of claim 1, wherein the internal electrical interface comprises an electrical charging interface which comprises charging contacts extending inward from at least one interior wall of the chamber.

7. The power receptacle of claim 1, wherein the internal electrical interface comprises a male USB connector.

8. The power receptacle of claim 1, wherein the housing comprises and/or is in communication with a circuit that connects to hot, ground and neutral of an electrical circuit.

9. A power receptacle, comprising:

a housing having an inwardly extending chamber, the inwardly extending chamber having a depth dimension that is between 0.5 and 5 inches sized and configured to releasably receive a portable power supply inside the chamber, wherein the depth dimension is greater than a width and height dimension, wherein the housing comprises an internal electrical interface in the chamber, wherein, when the portable power supply is in the chamber, the portable power supply electrically engages the electrical interface to thereby power and/or charge the portable power supply, wherein the power receptacle comprises at least one externally accessible electrical socket, and wherein in a ready-to-use configuration, the chamber directly and serially receives different user rechargeable power supplies;

a front cover attached to the housing, wherein the front cover comprises a window extending over a front end of the chamber; and first and second externally accessible electrical sockets with ports extending through the cover, one above the chamber and one below the chamber, as the at least one externally accessible electrical socket.

10. A power receptacle, comprising:

a housing having an inwardly extending chamber, the inwardly extending chamber having a depth dimension that is between 0.5 and 5 inches sized and configured to releasably receive a portable power supply inside the chamber, wherein the depth dimension is greater than a width and height dimension, wherein the housing comprises an internal electrical interface in the chamber, wherein, when the portable power supply is in the chamber, the portable power supply electrically engages the electrical interface to thereby power and/or charge the portable power supply, wherein the power receptacle comprises at least one externally accessible electrical socket, and wherein in a ready-to-use configuration, the chamber directly and serially receives different user rechargeable power supplies; and a front cover attached to the housing, the front cover comprising or exposing an ejection member that is configured to eject the portable charger from the chamber.

11. A power receptacle in combination with a portable rechargeable power supply of a respective user, comprising:

a housing having an inwardly extending chamber, the inwardly extending chamber having a depth dimension that is between 0.5 and 5 inches sized and configured to releasably receive a portable power supply inside the chamber, wherein the depth dimension is greater than a width and height dimension, wherein the housing comprises an internal electrical interface in the chamber, wherein, when the portable power supply is in the chamber, the portable power supply electrically engages the electrical interface to thereby power and/or charge the portable power supply, wherein the power receptacle comprises at least one externally accessible electrical socket, and wherein in a ready-to-use configuration, the chamber directly and serially receives different user rechargeable power supplies; and a portable rechargeable power supply of a respective user in the chamber, wherein the portable rechargeable power supply is configured to slidably enter the chamber and be held so that a front end thereof is flush, recessed or protrudes less than 0.25 inches from a front cover with a window over the chamber, the front cover attached to the housing, wherein the portable power supply comprises a first USB port on one end that is externally accessible when the power supply is in the chamber, and wherein the portable power supply comprises a second USB port that resides inside the chamber when the power supply is in the chamber for charging.

12. A power receptacle, comprising:

a housing having an inwardly extending chamber, the inwardly extending chamber having a depth dimension sized and configured to releasably receive a portable power supply inside the chamber, wherein the depth dimension is greater than a height dimension and greater than a width dimension, wherein the housing comprises an internal electrical interface, wherein, when the portable power supply is in the chamber, the portable power supply electrically engages the electrical interface to thereby power and/or charge the portable power supply, and wherein, in a ready-to-use configuration, the chamber directly and serially receives different user portable rechargeable power supplies as the portable power supply;

a ground strap attached to the housing;

at least one externally accessible electrical socket; and at least one externally accessible Universal Serial Bus (USB) port, wherein the at least one externally accessible electrical socket is configured as first and second externally accessible electrical sockets one above the chamber and one below the chamber, and wherein the at least one USB port resides adjacent the chamber, between the chamber and one of the at least one electrical socket.

13. The power receptacle of claim 12, further comprising;

a front cover attached to the housing, wherein the front cover has a shutter that opens to allow a respective portable power supply to be inserted into the chamber, and wherein the shutter pivots open in an outward direction along one long side edge thereof; and an eject member facing out of the cover, wherein a user can manually depress the eject member to cause the charger to be released from the chamber.

14. A power receptacle, comprising:

a housing having an inwardly extending chamber, the inwardly extending chamber having a depth dimension sized and configured to releasably receive a portable power supply inside the chamber, wherein the depth dimension is greater than a height dimension and greater than a width dimension, wherein the housing comprises an internal electrical interface, wherein, when the portable power supply is in the chamber, the portable power supply electrically engages the electrical interface to thereby power and/or charge the portable power supply, and wherein, in a ready-to-use configuration, the chamber directly and serially receives different user portable rechargeable power supplies as the portable power supply;

a ground strap attached to the housing;

at least one externally accessible electrical socket;

at least one externally accessible Universal Serial Bus (USB) port; and a front cover attached to the housing, wherein the front cover has a shutter that opens to allow a respective portable power supply to be inserted into the chamber, wherein the housing is configured to be or reside in a single gang box, and wherein the inwardly extending chamber is sized and configured to enclose at least a major portion of a length dimension of the portable power supply.

15. A method of charging and/or powering electronic devices, comprising:

serially inserting a portable charger of different users with at least one external electrical connector comprising a Universal Serial Bus (USB) into an inwardly extending chamber of a power receptacle to enclose at least a major portion of a length dimension of the portable power charger, wherein the power receptacle includes one or more plug-in sockets;

electrically directly engaging an internal electrical charging/powering interface inside the chamber at a depth that is inward of the one or more plug-in sockets when a respective power charger, of the serially inserted power chargers, is inserted into the chamber to charge and/or power the respective portable charger; then slidably removing the respective portable charger from the chamber; and moving a shutter across and/or over a front entry portion of the chamber after and/or in response to the slidably removing step.

16. The method of claim 15, wherein the power receptacle is a GFCI or AFCI power receptacle.

* * * * *